US005961091A

United States Patent [19]

Petryna et al.

[11] Patent Number: 5,961,091

[45] Date of Patent: Oct. 5, 1999

[54] POLE SUPPORT FOR USE ON DECKED SURFACES

[76] Inventors: Thomas Michael Petryna, 615 Guy St. Cornwall, Ontario, Canada, K6H 4V9; Raymond Albert Delorme, 706 Montreal Rd. Cornwall, Ontario, Canada, K6H 1C4

[21] Appl. No.: 08/936,645

[22] Filed: Sep. 24, 1997

[51] Int. Cl.[6] ..... F16M 13/00

[52] U.S. Cl. ..... 248/523; 248/500

[58] Field of Search ..... 248/519, 523, 248/539, 500, 507, 535, 910, 346.03, 511, 536; 135/16; 43/21.2

[56] References Cited

U.S. PATENT DOCUMENTS

| | | | |
|---|---|---|---|
| 1,026,475 | 5/1912 | Tarbuck | 248/507 X |
| 1,769,498 | 7/1930 | Downing | 248/507 X |
| 4,235,409 | 11/1980 | Cummings | 248/538 |
| 4,582,287 | 4/1986 | DeLeary | 248/519 |
| 4,637,156 | 1/1987 | Simmons | 43/21.2 |
| 4,803,794 | 2/1989 | Lopez | 43/21.2 |
| 5,120,016 | 6/1992 | Dysarz | 248/539 |
| 5,187,891 | 2/1993 | Stanishewski | 43/21.2 |
| 5,488,798 | 2/1996 | Beachel | 43/21.2 |
| 5,566,495 | 10/1996 | Kim et al. | 43/21.2 |
| 5,685,517 | 11/1997 | Salibra | 248/507 X |
| 5,816,554 | 10/1998 | McCracken | 248/519 X |

*Primary Examiner*—Ramon O. Ramirez

*Attorney, Agent, or Firm*—Pearne, Gordon, McCoy & Granger LLP

[57] ABSTRACT

A pole support for use on decked surfaces consisting of planks with a gap between the planks is described. The pole support includes a base and at least one I-shaped retainer bar for quickly and easily attaching and releasing the base from the deck surface. The base includes a tubular sleeve for supporting the pole in a predetermined orientation with respect to the base. The pole support is useful for attaching articles such as umbrella tables or plant stands to a decked surface. The advantage is a simple, inexpensively constructed pole support which is not susceptible to corrosion and may be rapidly connected to or disconnected from a decked surface without the use of tools.

21 Claims, 3 Drawing Sheets

POLE SUPPORT FOR USE ON DECKED SURFACES

TECHNICAL FIELD

The present invention relates to means for supporting poles on a surface without altering or marring the surface and, in particular for pole supports for use with decked surfaces consisting of planks with a gap between the planks.

BACKGROUND OF THE INVENTION

The utility of a support for a pole which may be used on a surface without marring or changing the surface has long been recognized. Decked surfaces such as patio decks, piers and boardwalks are frequently used for recreational purposes which requires furniture and the like. Since such surfaces are commonly exposed to wind, it is desirable to be able to anchor articles susceptible to wind damage to the deck surface. Umbrellas and umbrella tables are particularly susceptible to such damage and many holders and stands for those articles have been invented.

For example, U.S. Pat. No. 5,120,016 which issued Jun. 19, 1992 to Dysarz describes a device that can be fixed to a sundeck or a deck of a dock or pier by means of a T-bar extending through the spaces between the floor boards or planks of the sundeck or dock of a pier. The T-bar is inserted into the space and rotated 90° to where the T-bar catches the board or planks. A threaded plug is affixed to the shaft of the T-bar to prevent the T bar from falling out of the space between the floor boards. A T-flange with an underside thread is screwed onto the threaded plug pulling the T-flange into the bottom side of the planks locking the T-flange and the T-bar to the planks. A fishing rod or other item is placed into the vertical tube of the T-flange and is held by gravity or other means. The problem with this device is that it is complicated to manufacture and subject to corrosion.

While many other simpler devices for supporting umbrellas and fishing rods or the like have been invented, those devices generally include screw fasteners which are subject to corrosion or prone to loss, or are bulky concrete-filled anchors that are dangerous to handle because of their weight. There therefore exists a need for a simple pole support for use on deck surfaces which is inexpensive to manufacture and may be quickly connected to or disconnected from deck surfaces without the use of tools while providing secure support for articles supported by poles such as umbrellas and umbrella tables.

SUMMARY OF THE INVENTION

It is an object of the invention to provide a pole support for use on deck surfaces which does not require threaded fasteners.

It is a further object of the invention to provide a pole support for use on deck surfaces which is simple to manufacture and easy to use.

It is a further object of the invention to provide a pole support for use on deck surfaces which permits the support to be rapidly connected to or disconnected from the surface to permit easy relocation of the pole support.

The invention provides a pole support for use on decked surfaces consisting of planks with a gap between the planks, comprising in combination:

at least one I-shaped retainer bar, the I-shaped retainer bar being adapted to be inserted through a one of the gaps in the decked surface when oriented in a first orientation and to engage an underside of planks adjacent to the gap when oriented in a second orientation;

a base having a peripheral edge and a top surface, the base including at least one slot that extends inwardly from the peripheral edge through the top surface, and the top surface forming a ramp at the at least one slot, the ramp including at least one detent for retaining a top of the I-shaped bar when the I-shaped bar is in the second orientation; and pole retainer means connected to the base for retaining the pole in a predetermined orientation with respect to the base.

The pole support in accordance with the invention preferably consists of a pair of I-shaped retainer bars which engage a base that may be practically any shape but is preferably square or rectangular. The base has a top surface which slopes upwardly from peripheral edges thereof. The base includes at least one slot which extends through the top surface. The slot accommodates an I-shaped retainer bar to permit the base to be securely attached to the deck surface. Associated with the slot is at least one detent for inhibiting the bar from sliding out of the slot. The detent is preferably a groove or a ridge oriented at right angles to the slot. In use, the base is placed on the deck surface and oriented so that the slot aligns with a gap between the planks. An I-shaped retainer bar is inserted through the gap and rotated 90° so that a bottom cross-member of the retainer bar engages the planks. The retainer bar is then slid through the slot until it engages the inclined top surface and is retained by one of the detents.

The pole support is very light, inexpensively manufactured and extremely simple to use while providing a pole support that is capable of supporting even large, heavy umbrellas or the like.

BRIEF DESCRIPTION OF THE DRAWINGS

The invention will now be explained by way of example only and with reference to the following drawings wherein.

DETAILED DESCRIPTION OF THE PREFERRED EMBODIMENTS

Figure 1:
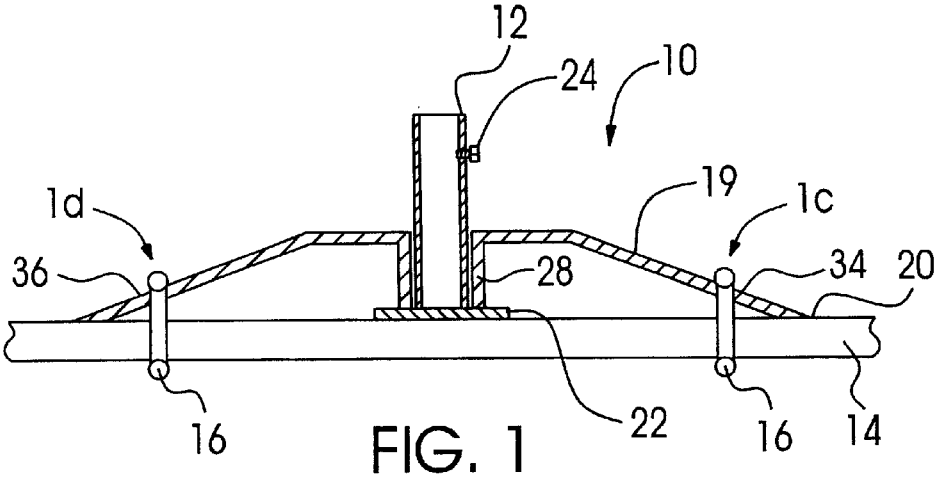
FIG. 1 is a cross-sectional view of a first preferred embodiment of a pole support in accordance with the invention showing the support connected to a deck surface.

FIG. 1 shows a cross-sectional view of a preferred embodiment of the pole support in accordance with the invention. The pole support includes a base generally indicated by reference 10 and a pole retainer 12 which is supported by the base 10. The base 10 is secured to the planks 14 of a decked surface using a pair I-shaped retainer bars 16 which are retained in slots 18 (see FIG. 1*a*) as will be explained below in more detail.

The base 10 has a top surface 19 and a peripheral edge 20. The top surface 19 inclines upwardly from the peripheral edge 20. The base 10 of a preferred embodiment of the invention is preferably square and has a truncated pyramid shape. The pole retainer 12 is preferably a tubular sleeve having a circular flange 22 which prevents the pole retainer 12 from being removed from a top of the base. A set screw 24 extends through a radial tapped bore in a sidewall of the tubular pole retainer 12. When a pole is inserted into the pole retainer 12, the set screw 24 may be tightened against the pole to lock it within the pole retainer 12.

Figure 1A:
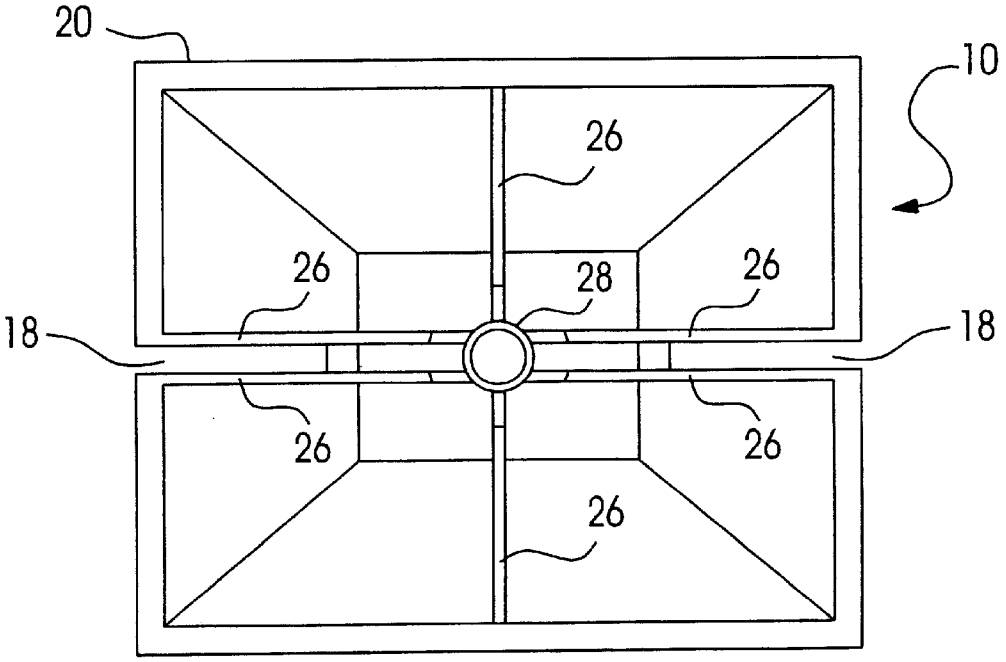
FIG. 1*a* is a bottom plan view of the pole support shown in FIG. 1.

FIG. 1*a* shows a bottom plan view of the preferred embodiment of the invention shown in FIG. 1. The base 10 is preferably a plastic structure moulded from a durable polymer such as ABS. The base 10 also is preferably a hollow structure to minimize weight and material. In accordance with the preferred embodiment, a reinforcing rib 26 extends inwardly from each peripheral edge 20 to a cylindrical support 28 for the pole retainer 12. Likewise, a pair of reinforcing ribs 26 flank each side of the slots 18 which receive the I-shaped retainer bars 16. The pole retainer 12 is inserted into the cylindrical support 28 from a bottom of the base 10. To accomplish this, the set screw 24 is removed until the pole retainer 12 is inserted through the cylindrical support 28. The set screw 24 is then reinstalled which prevents the pole retainer 12 from slipping out of the base 10. The pole retainer 12 may, of course, also be an integral part of the base 10. It is preferred for purposes of durability that the pole retainer 12 be an independent unit made from aluminum or steel.

Figure 1B:
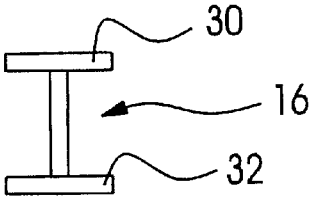
FIG. 1*b* is an elevational view of an I-shaped retainer bar in accordance with the invention.

FIG. 1*b* shows an elevational view of an I-shaped retainer bar 16 in accordance with the invention. The I-shaped retainer bar may be made of metal or moulded from a high-density plastic. High-density plastics reinforced with fibreglass or carbon fibre are preferred. The I-shaped retainer bar is preferably circular in cross-section; though other shapes are equally functional. The I-shaped retainer bar 16 is preferably not more than about ¼ inch (0.8 cms) in diameter so that it readily fits the gap of most deck structures. It is preferably about 2¼ inches (5.8 cms) in length so that it may be used on deck structures having planks of any normal thickness. The I-shaped retainer bar 16 includes a top cross member 30 and a bottom cross member 32 which are parallel and preferably of equal length.

Figure 1C:
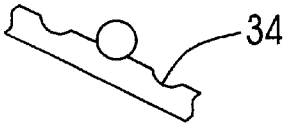
FIG. 1*c* is an exploded view showing a first preferred structure for detents for locking the retainer bar to the pole support.

FIG. 1*c* shows an exploded view of a first preferred structure for the detents for locking the I-shaped retainer bar 16 to the base 10. In a first preferred structure, the detents are shallow grooves which are spaced apart at regular intervals to accommodate decking planks of different thickness. In use, the top cross member of the retainer bar 16 is slid up the inclined top surface 19 of the base 10 until it is snugly received in a groove 34. The grooves 34 cross the slot 18 and are oriented at right angles thereto. The grooves 34 are of sufficient length to accommodate top cross member 30 of the I-shaped retainer bar 16.

Figure 1D:
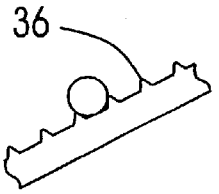
FIG. 1*d* is an exploded view of a second preferred structure for detents for locking the retainer bar to the pole support.

FIG. 1*d* shows an exploded view of an alternate structure for the detents for retaining the I-shaped retainer bar 16 in the slot 18 of the base 10. This alternate structure is a series of spaced-apart ridges 36 oriented at right angles to the slot 18. The ridges 36 cross the slot 18 and are of adequate length to securely lock the top cross member 30 of the I-shaped retainer bar 16 to the top surface 19 of the base 10. The ridges 36 function in exactly the same way as the grooves 34 described above.

Figure 2:
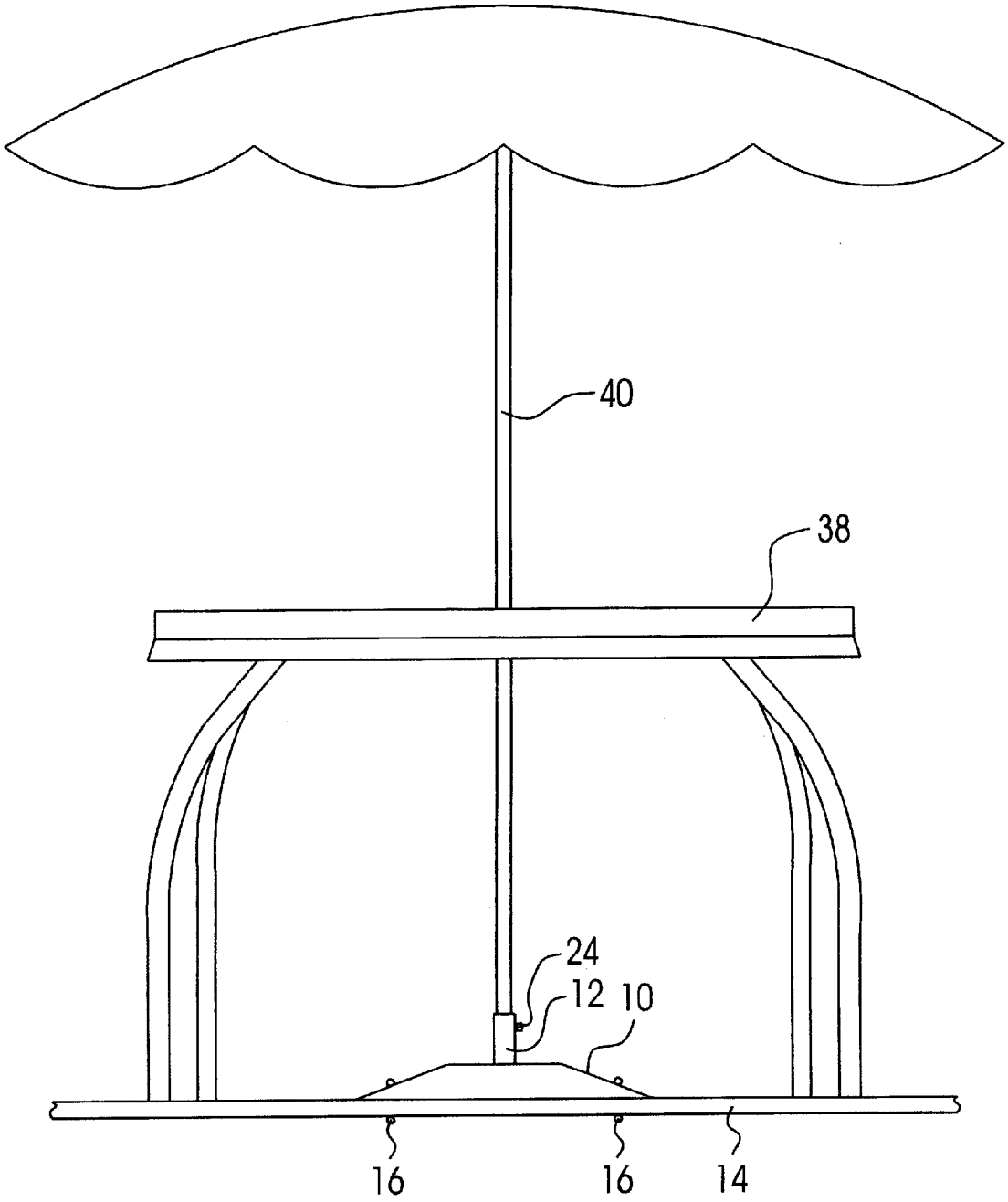
FIG. 2 is an elevational view of the pole support in use supporting an umbrella.

FIG. 2 shows a side elevational view of the pole support in use supporting an umbrella table. The base 10 is of particular utility because of its very light weight, its low profile and its tapered edges which do not interfere with seating around the table, and permits the table to be quickly relocated without strain while providing secure support adequate to prevent the table from being blown over in even strong winds. In use, the base 10 is positioned on the deck surface in a desired location so that the slots 18 align with a gap between planks and the I-shaped retainer bars are inserted through the gap then rotated 90° and slid into the opposed slots 18 until they are locked to the top surface 19 of the base 10 by the detents 34,36. The umbrella table 38 is positioned over the base 10 and the umbrella pole 40 is inserted through the umbrella table 38 and into the pole retainer 12. The set screw 24 is then tightened against the umbrella pole 40 to lock it in the pole retainer.

Figure 3:
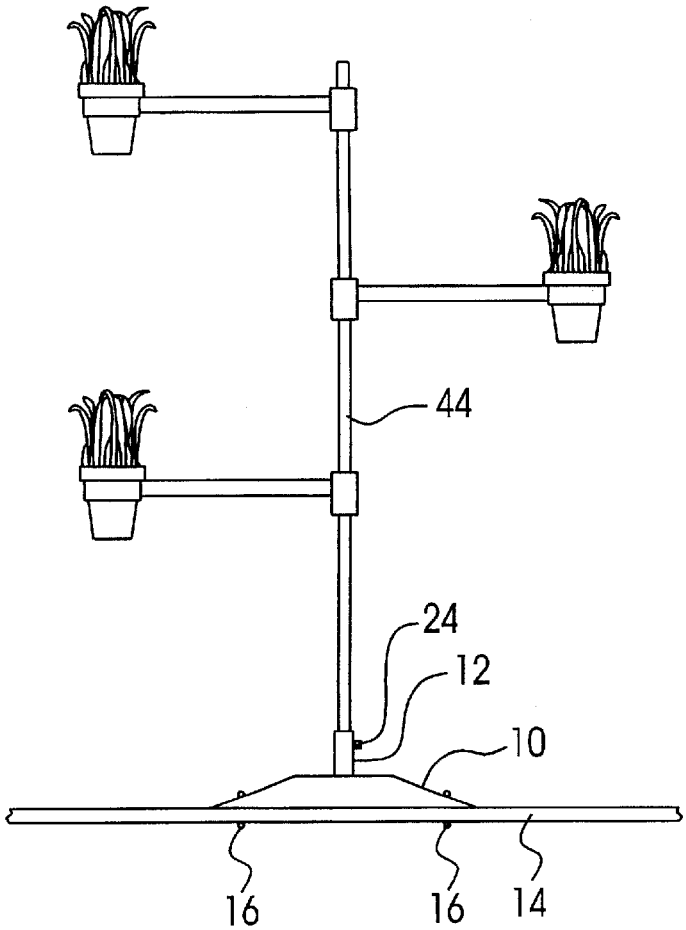
FIG. 3 is a side elevational view of the pole support in use supporting a plant stand.

The pole support in accordance with the invention also has many other uses. For example, as shown in FIG. 3, the pole support may be used to support a plant stand 44 or the like. It is also useful for supporting a small flagpole, a fishing rod, or the poles for a badminton net, for example.

Figure 4:
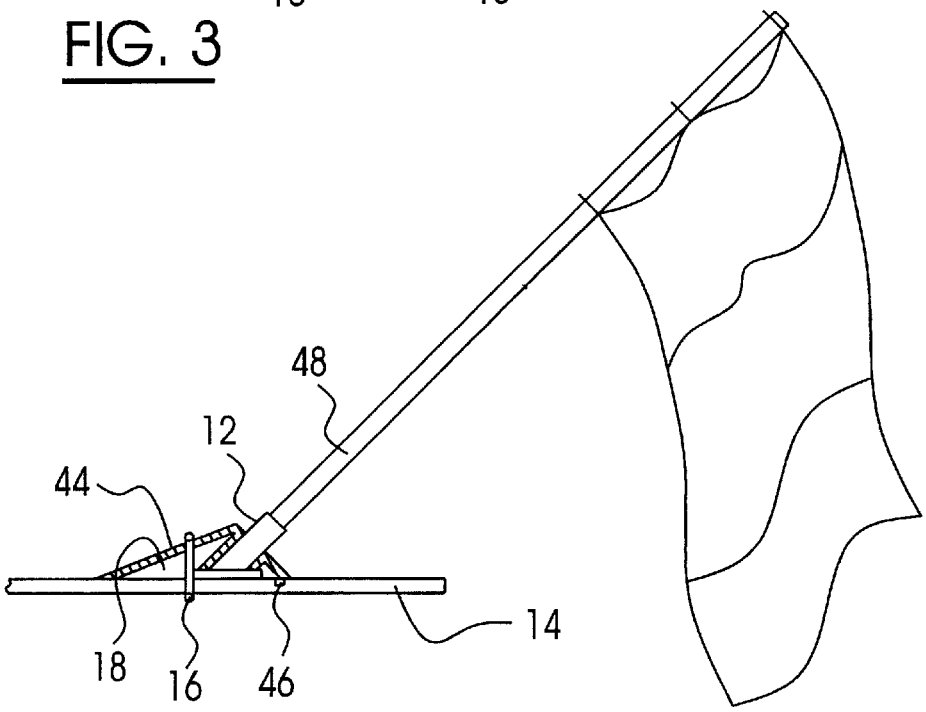
FIG. 4 is a cross-sectional view of an alternate embodiment of the pole support in accordance with the invention.

FIG. 4 shows an alternate embodiment of the invention useful for more light-duty applications. In this embodiment, a wedge-shaped base 44 is secured to the planks 14 of a decked surface by a single I-shaped retainer bar 16 which engages a single slot 18 in the wedge-shaped base 44. The pole support 12 may be oriented at any desired angle. In this embodiment, the pole retainer 12 is oriented at about a 45° angle with respect to the bottom of the wedge-shaped base 44. Any other angle is also practical. Since the wedge-shaped base 44 is secured to the planks 14 by a single I-shaped retainer bar, it is preferable that an opposite edge of the wedge-shaped base 44 be provided with a downwardly projecting pin 46 sized to engage a gap between the planks 14 to prevent the wedge-shaped base 44 from rotating when force is applied to a pole retained by the pole retainer 12 such as the flagpole 48. This embodiment is attached to the deck as described above and has many practical applications, including supporting a fishing pole, a lantern pole, or the like.

Changes and modifications to the embodiments described will be apparent to those skilled in the art. The scope of the invention is therefore intended to be limited solely by the scope of the appended claims.

We claim:

1. A pole support for use on decked surfaces consisting of planks with a gap between the planks, comprising in combination:

at least one I-shaped retainer bar, the I-shaped retainer bar being adapted to be inserted through a one of the gaps in the decked surface when oriented in a first orientation and to engage an underside of planks adjacent the gap when oriented in a second orientation;

a base having a peripheral edge and a top surface, the base including at least one slot that extends inwardly from the peripheral edge through the top surface, and the top surface forming a ramp at the at least one slot, the ramp including at least one detent for retaining a top of the I-shaped bar when the I-shaped bar is in the second orientation; and pole retainer means connected to the base for retaining a pole in a predetermined orientation with respect to the base.

2. A pole support for use on a decked surface as claimed in claim 1 wherein the pole retainer means comprises a tubular sleeve and a set screw which extends radially through a sidewall of the tubular sleeve to permit a pole to be locked within the tubular sleeve when the set screw is tightened against the pole inserted therein.

3. A pole support for use on a decked surface as claimed in claim 1 wherein the detent comprises a groove which extends across the slot, the groove being oriented at right angles to the slot and having a total length adapted to accommodate a top of the I-shaped bar to inhibit the bar from disengaging the slot.

4. A pole support for use on a decked surface as claimed in claim 1 wherein the detent comprises a ridge which extends across the slot, the ridge being oriented at right angles to the slot and adapted to inhibit the I-shaped bar from disengaging the slot.

5. A pole support for use on a decked surface as claimed in claim 1 wherein the base is square.

6. A pole support for use on a decked surface as claimed in claim 5 wherein the top surface has a truncated pyramid shape.

7. A pole support for use on a decked surface as claimed in claim 1 wherein the pole is a pole of an umbrella.

8. A pole support for use on a decked surface as claimed in claim 7 wherein the umbrella is an umbrella for an umbrella table.

9. A pole support for use on a decked surface as claimed in claim 1 wherein the pole is a support for potted plants.

10. A pole support for use on a decked surface consisting of planks with a gap between the planks, comprising in combination:

two I-shaped bars having a central shaft sized to fit between the planks and top and bottom parallel cross members having a length that is greater than an average width of the gap between the planks;

a base having a peripheral edge and a top surface, the top surface having a centre portion that is higher than the peripheral edge so that the top surface tapers upwardly from the peripheral edge;

two opposed slots that extend inwardly from the peripheral edge and through the top surface;

at least one detent associated with each slot for retaining the top cross member of a one of the I-shaped bars when the I-shaped bar is inserted through a gap in the decked surface and oriented so that the bottom cross member engages an underside of the planks; and a tubular sleeve affixed to the base for supporting a pole in a predetermined orientation.

11. A pole support for use on a decked surface as claimed in claim 10 wherein the pole support further includes means for retaining the pole in the tubular sleeve.

12. A pole support for use on a decked surface as claimed in claim 10 wherein the means for retaining the pole in the tubular sleeve comprises a set screw that extends radially through a sidewall of the tubular sleeve and locks the pole in the tubular sleeve when the pole is inserted therein and the set screw is tightened against the pole.

13. A pole support for use on a decked surface as claimed in claim 10 wherein the detent is a groove that extends across a slot, the groove being oriented at right angles to the slot and having a length adapted to accommodate a top cross member of a one of the I-shaped bars to inhibit the I-shaped bar from sliding out of the slot when the bottom cross member of the I-shaped bar engages an underside of the planks.

14. A pole support for use on a decked surface as claimed in claim 13 wherein each slot includes at least two detents to accommodate decked surfaces having planks of different thickness.

15. A pole support for use on a decked surface as claimed in claim 10 wherein the detent is a ridge that extends across a slot, the ridge being oriented at right angles to the slot and having a length adapted to inhibit the I-shaped bar from sliding out of the slot when the bottom cross member of the I-shaped bar engages an underside of the planks.

16. A pole support for use on a decked surface as claimed in claim 15 wherein each slot includes at least two detents to accommodate decked surfaces having planks of different thickness.

17. A pole support for use on a decked surface as claimed in claim 10 wherein the base is a moulded plastics material.

18. A pole support for use on a decked surface as claimed in claim 10 wherein the pole is an umbrella pole.

19. A pole support for use on a decked surface as claimed in claim 18 wherein the umbrella is an umbrella for an umbrella table.

20. A pole support for use on a decked surface as claimed in claim 10 wherein the pole is a plant stand.

21. A pole support for use on a decked surface as claimed in claim 10 wherein the base is square.

* * * * *